US009185937B2

(12) United States Patent
Liu

(10) Patent No.: US 9,185,937 B2
(45) Date of Patent: Nov. 17, 2015

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 52 days.

(21) Appl. No.: 14/115,631

(22) PCT Filed: Jan. 15, 2013

(86) PCT No.: PCT/CN2013/070463

§ 371 (c)(1),
(2) Date: Nov. 4, 2013

(87) PCT Pub. No.: WO2014/110710

PCT Pub. Date: Jul. 24, 2014

(65) Prior Publication Data

US 2014/0196735 A1 Jul. 17, 2014

(51) Int. Cl.
*A24F 47/00* (2006.01)

(52) U.S. Cl.
CPC ..... *A24F 47/008* (2013.01)

(58) Field of Classification Search
CPC ... A24F 47/002; A24F 47/004; A24F 47/006; A24F 47/008; A61M 15/06
See application file for complete search history.

(56) References Cited

U.S. PATENT DOCUMENTS

| | | | | |
|---|---|---|---|---|
| 4,049,482 | A * | 9/1977 | Webb | 156/172 |
| 2010/0300467 | A1* | 12/2010 | Kuistila et al. | 131/328 |
| 2011/0265806 | A1* | 11/2011 | Alarcon et al. | 131/273 |
| 2011/0303231 | A1* | 12/2011 | Li et al. | 131/329 |
| 2013/0061861 | A1* | 3/2013 | Hearn | 131/329 |
| 2013/0213418 | A1* | 8/2013 | Tucker et al. | 131/328 |
| 2013/0228191 | A1* | 9/2013 | Newton | 131/329 |
| 2013/0247924 | A1* | 9/2013 | Scatterday et al. | 131/329 |

FOREIGN PATENT DOCUMENTS

CN 202354377 * 8/2012

OTHER PUBLICATIONS

CN202354377 Translation, Aug. 2012, Xu et al.*

* cited by examiner

*Primary Examiner* — Richard Crispino
*Assistant Examiner* — Eric Yaary
(74) *Attorney, Agent, or Firm* — Cheng-Ju Chiang

(57) ABSTRACT

The invention is related to an electronic cigarette, including a hollow and tubular cigarette pipe, the cigarette pipe being divided into a cigarette rod and a mouthpiece, and the cigarette rod and/or the mouthpiece have paper film attached on its surface. With paper film attached to outer surface of the cigarette rod and/or the mouthpiece, the electronic cigarette presents a real feeling as gripping cigarette between fingers or in mouth, a high simulation, and a realer experience to the user.

13 Claims, 2 Drawing Sheets

ELECTRONIC CIGARETTE

CROSS REFERENCE TO RELATED APPLICATIONS

The present application is a 35 U.S.C. §371 National Phase conversion of International (PCT) Patent Application No. PCT/CN2013/070463, filed on Jan. 15, 2013, the disclosure of which is incorporated by reference herein. The PCT International Patent Application was filed in Chinese.

BACKGROUND OF THE INVENTION

1. Field of the Invention

The present invention relates to an electronic cigarette.

2. Related Art

An electronic cigarette is a simulated cigarette, in which electric heat wire vaporizes the scent media into vapor mists to be inhaled by the user. An attached film to an outside wall of the existing electronic cigarette in the market primarily uses a kind of plastic attached film (also known as synthetic paper or plastic film) to be wholly attached on the outer tube wall by a printing process.

In use of plastic film, surface of the film of plastic material is smooth, it feels stiff, unreal and without the real feeling as gripping cigarette between fingers or in mouth.

SUMMARY OF THE INVENTION

An object of the present invention is to provide an electronic cigarette presenting a cigarette feeling.

To achieve the above object, an electronic cigarette of the present invention, comprises: a hollow and tubular cigarette pipe, the cigarette pipe is divided into a cigarette rod and a mouthpiece, and the cigarette rod and/or the mouthpiece have paper film attached on its surface.

Furthermore, the cigarette pipe has plastic film attached on its section without paper film.

Furthermore, there is a plastic film further attached on an outer surface of the paper film.

Furthermore, the paper film is made from one or more materials chosen from writing paper, heat sensitive paper, or copperplate paper.

Furthermore, the plastic film uses one or more kinds chosen from PET film, PP film or PVC film Furthermore, the mouthpiece of the electronic cigarette is set with a mouthpiece cover at its corresponding end, and the mouthpiece cover defines an inhaling hole therein.

Furthermore, the mouthpiece cover is made from one or more materials chosen from silica gel, rubber, foam, or EVA material.

Furthermore, the cigarette rod of the electronic cigarette at its corresponding end is set with a transparent cigarette cap, the cigarette cap has a spherical shape convex outward, and a light source is set inside the cigarette cap.

Furthermore, the cigarette pipe is made from one or more materials chosen from silica gel, rubber, foam, or EVA material.

Furthermore, the cigarette pipe is set with a tobacco-liquid cup therein, and the tobacco-liquid cup comprises a cup body which is concentrically and tensionally fitted on inner wall of the cigarette pipe and an atomizing seat which is hermetically fixed to one end of the cup body.

Furthermore, an atomizing device is fixed in the cup body along its radial direction, and the atomizing device comprises a liquid-guiding piece abutting against inner wall of the cup body and an electric heat wire round the liquid-guiding piece.

Furthermore, the cup body comprises a hollow tubular liquid-storing cotton, a liquid-guiding cotton, a first glass-fiber tube and a second glass-fiber tube; the liquid-storing cotton is fitted on inner wall of the cigarette pipe and is concentric with the cigarette pipe; the liquid-guiding cotton is fitted on inner wall of the liquid-storing cotton, concentric to the cigarette pipe and with engagement of the atomizing device; a middle section of the liquid-guiding cotton peripherally defines a groove; the first glass-fiber tube forms a spiral by a glass fiber being spirally wound, and is received in the groove; the second glass-fiber tube is fitted on inner wall of the first glass-fiber tube and the liquid-guiding cotton, and concentric with the cigarette pipe.

Furthermore, a battery is set in the cigarette pipe at its end corresponding to the cigarette rod; two electrodes of the battery are connected with both ends of the electric heat wire by wires respectively passing through the atomizing seat and the cup body.

Furthermore, a fixing bracket is set in the cigarette pipe at its end corresponding to the cigarette rod, and an air sensor is mounted in the fixed bracket with an electric connection to the battery.

The present invention has advantages as: with paper film attached to outer surface of the cigarette rod and/or the mouthpiece, the electronic cigarette presents a real feeling as gripping cigarette between fingers or in mouth, a high simulation, and a realer experience to the user.

DESCRIPTION OF THE PREFERRED EMBODIMENTS

It is necessary to explain that, provided no conflicts in any way, the embodiments or characteristics in the embodiments of the present invention can be combined each other and detailed description of the present invention is given below in conjunction with appendix drawings.

Figure 1:
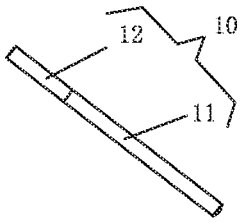
FIG. 1 is a front view of an electronic cigarette of the present invention.
Figure 2:
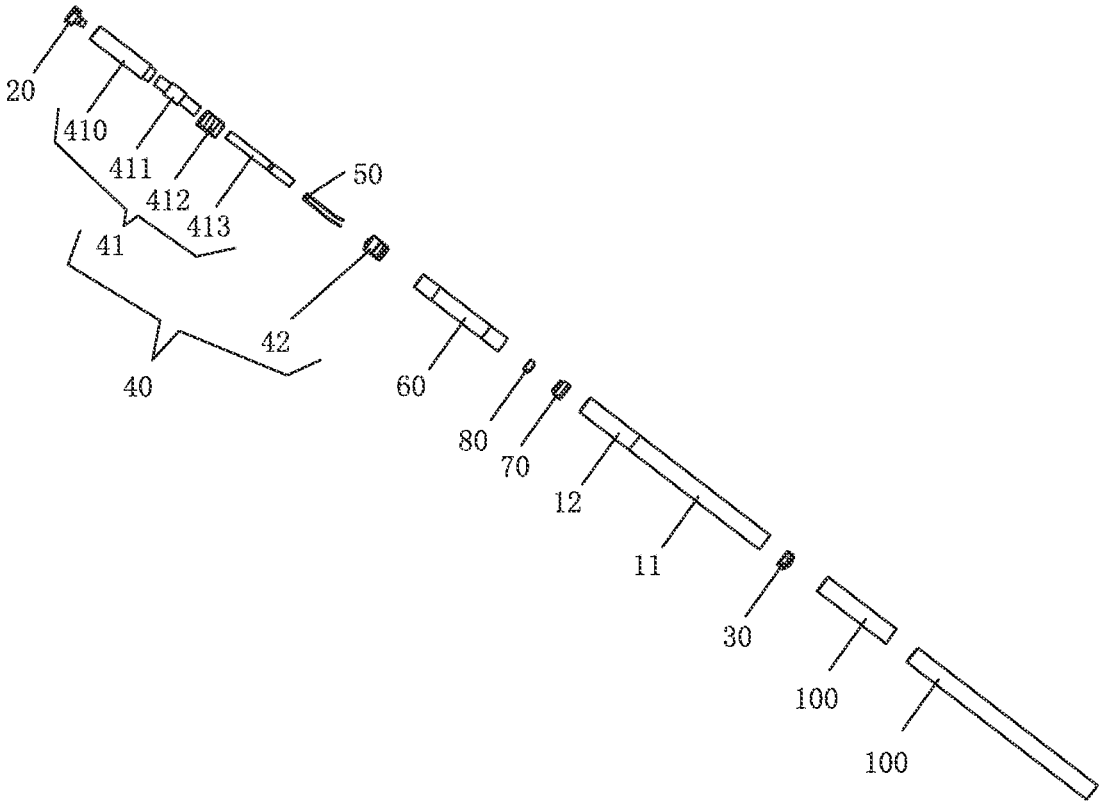
FIG. 2 is an exploded view of the electronic cigarette of FIG. 1.
Figure 3:
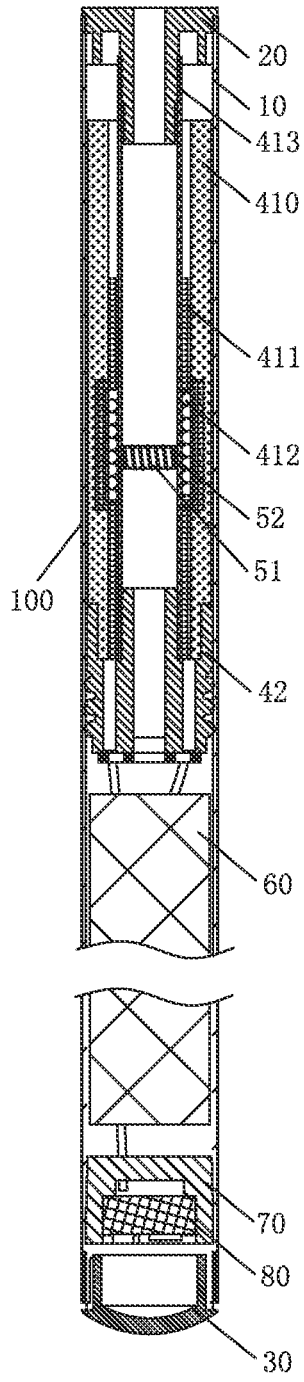
FIG. 3 is a cross-sectional view of the electronic cigarette of FIG. 1.

As shown in FIGS. 1 to 3, the present invention is to provide an electronic cigarette, comprising a hollow tubular cigarette pipe 10, and the cigarette pipe 10 is divided into a cigarette rod 11 and a mouthpiece 12. Surfaces of the cigarette rod 11 and/or the mouthpiece 12 are attached with plastic film. Herein, the cigarette pipe 10 is made from one or more materials chosen from silica gel, rubber, foam, or EVA materials.

In accordance with the first embodiment, the attached film on the mouthpiece 12 is a kind of plastic film, and the attached film on the cigarette rod 11 is a kind of paper film. In accordance with the second embodiment, the attached film on the mouthpiece 12 is paper film 100, and the attached film on the cigarette rod 11 is plastic film. In accordance with the third embodiment, the surface of the cigarette tube 10 is firstly and wholly attached with a piece of paper film 100, and a piece of plastic film is further attached on the paper film 100 of the mouthpiece 12. In accordance with the fourth embodiment, the surface of the cigarette tube 10 is firstly and wholly attached with a piece of paper film 100, and a piece of plastic film is further attached on the paper film 100 of the cigarette rod 11. Comparing with an existing electronic cigarette only with plastic film, the electronic cigarette of the present invention presents the user a real feeling as the traditional cigarette being gripped between fingers or contained in mouth, a high simulation, and a realer experience. Additionally, as the attached film to the mouthpiece 12 is plastic film in accordance with the embodiments, the electronic cigarette can prevent from being soaked or wetting by saliva of the user.

Herein, the paper film 100 uses one or more materials chosen from writing paper, heat-sensitive paper, or copperplate paper, and the plastic film uses one or more kinds of film chosen from PET film, PP film or PVC film.

The mouthpiece 12 of the electronic cigarette has its corresponding end fitted with a mouthpiece cover 20. The mouthpiece cover 20 has an inserting end adapted to the cigarette pipe 10, and the mouthpiece cover 20 defines an inhaling hole therethrough. Herein, the mouthpiece cover 20 is made from one or more materials chosen from silica gel, rubber, foam, or EVA material.

The cigarette rod 11 of the electronic cigarette has its corresponding end fitted with a transparent cigarette cap 30. The cigarette cap 30 has a spherical shape convex outward, and a light source is set inside the cigarette cap 30.

The electronic cigarette further comprises tobacco-liquid cup 40, an atomizing device 50 and a battery 60.

Specifically, the tobacco-liquid cup 40 is set in the cigarette pipe 10, comprising a cup body 41 and an atomizing seat 42. The cup body 41 is concentrically and tensionally fitted in the cigarette pipe 10, and the atomizing seat 42 is hermetically fixed to one end of the cup body 41. The cup body 41 comprises a hollow and tubular liquid-storing cotton 410, a liquid-guiding cotton 411, a first glass-fiber tube 412 and a second glass-fiber tube 413. Herein, the liquid-storing cotton 410 is fitted on inner wall of the cigarette pipe 10 and is concentric with the cigarette pipe 10; the liquid-guiding cotton 411 is fitted on inner wall of the liquid-storing cotton 410, and is concentric to the cigarette pipe 10 with engagement of the atomizing device 50, a middle section of the liquid-guiding cotton 41 peripherally defines a groove; the first glass-fiber tube 412 forms a spiral by a glass fiber being spirally wound, and is received in the groove; the second glass-fiber tube 413 is fitted on inner wall of the first glass-fiber tube 412 and the liquid-guiding cotton 411, and is concentric to the cigarette pipe 10. In use of the above configuration, tobacco liquid is absorbed faster and much concentrated, and the atomizing device 50 is gripped and fixed tighter.

The atomizing device 50 is fixed in the cup body 41 along its radial direction, and comprises a liquid-guiding piece 51 which crosses corresponding holes of the second glass-fiber tube 413 and then abutting on inner wall of the first glass-fiber tube 412, and an electric heat wire 52 round the liquid-guiding piece 51. Herein, the liquid-guiding piece is made from glass-fiber with good liquid-suction performance.

The battery 60 is set in the cigarette pipe 10 at its end corresponding to the cigarette rod 11. Two electrodes of the battery 60 connect with both ends of the electric heat wire 52 by wires respectively passing through the atomizing seat 42 and cup body 41.

The electronic cigarette further comprises a fixing bracket 70 and an air sensor 80. Specifically, the fixing bracket 70 is set in the cigarette pipe 10 at the end corresponding to the cigarette rod 11, and the air sensor 80 is mounted in the fixed bracket 70 with an electric connection to the battery 60.

While the embodiments of the present invention have been illustrated and described, it will be understood that various changes, amendments, substitutions, and modifications can be made by those skilled in the art without departing from the principle and the spirit of the embodiments of the present invention, and it is intended that the scope of the invention be defined by the Claims appended hereto and their equivalents.

What is claimed is:

1. An electronic cigarette, comprising a hollow and tubular cigarette pipe, the cigarette pipe comprising a cigarette rod and a mouthpiece, wherein the cigarette rod and/or the mouthpiece have paper film attached on its surface;

the cigarette pipe is set with a tobacco-liquid cup therein, and the tobacco-liquid cup comprises a cup body which is concentrically and tensionally fitted on an inner wall of the cigarette pipe and an atomizing seat which is hermetically fixed to one end of the cup body;

an atomizing device is fixed in the cup body along its radial direction, and the atomizing device comprises a liquid-guiding piece and an electric heat wire round the liquid-guiding piece;

the cup body comprises a hollow tubular liquid-storing cotton, a liquid-guiding cotton, a first glass-fiber tube and a second glass-fiber tube; the liquid-storing cotton is fitted on the inner wall of the cigarette pipe and is concentric with the cigarette pipe; the liquid-guiding cotton is fitted on an inner wall of the liquid-storing cotton, concentric to the cigarette pipe and with engagement of the atomizing device; a middle section of the liquid-guiding cotton peripherally defines a groove; the first glass-fiber tube forms a spiral by a glass fiber being spirally wound, and is received in the groove; the second glass-fiber tube is fitted on an inner wall of the first glass-fiber tube and the liquid-guiding cotton, and is concentric with the cigarette pipe; and the liquid-guiding piece of the atomizing device crosses holes of the second glass-fiber tube and then abutting on the inner wall of the first glass-fiber tube; whereby tobacco liquid is absorbed fast and much concentrated for the electric heat wire and the atomizing device is gripped and fixed tight.

2. The electronic cigarette of claim 1, wherein the cigarette pipe has plastic film attached on its section without paper film.

3. The electronic cigarette of claim 1, wherein there is a plastic film further attached on an outer surface of the paper film.

4. The electronic cigarette of claim 1, wherein the paper film is made from one or more materials chosen from writing paper, heat sensitive paper, or copperplate paper.

5. The electronic cigarette of claim 2, wherein the plastic film uses one or more kinds of chosen from PET film, PP film or PVC film.

6. The electronic cigarette of claim 1, wherein the mouthpiece of the electronic cigarette is set with a mouthpiece cover at its corresponding end and the mouthpiece cover defines an inhaling hole.

7. The electronic cigarette of claim 6, wherein the mouthpiece cover is made from one or more materials chosen from silica gel, rubber, foam, or EVA materials.

8. The electronic cigarette of claim 1, wherein the cigarette rod of the electronic cigarette at its corresponding end is set with a transparent cigarette cap, the cigarette cap has a spherical shape convex outward, and a light source is set inside the cigarette cap.

9. The electronic cigarette of claim 1, wherein the cigarette pipe is made from one or more materials chosen from silica gel, rubber, foam, or EVA materials.

10. The electronic cigarette of claim 1, wherein a battery is set in the cigarette pipe at its end corresponding to the cigarette rod; two electrodes of the battery are connected with both ends of the electric heat wire by wires respectively passing through the atomizing seat and cup body.

11. The electronic cigarette of claim 10, wherein a fixing bracket is set in the cigarette pipe at its end corresponding to the cigarette rod, and an air sensor is mounted in the fixed bracket with an electric connection to the battery.

12. The electronic cigarette of claim 3, wherein the plastic film uses one or more kinds of chosen from PET film, PP film or PVC film.

13. An electronic cigarette, comprising a hollow and tubular cigarette pipe, the cigarette pipe comprising a cigarette rod and a mouthpiece, wherein the cigarette pipe is set with a tobacco-liquid cup and an atomizing device therein; the tobacco-liquid cup is set in the cigarette pipe, comprising a cup body and an atomizing seat fixed to one end of the cup body, the cup body is concentrically fitted in the cigarette pipe; the cup body comprises a hollow and tubular liquid-storing cotton, a liquid-guiding cotton, a first glass-fiber tube and a second glass-fiber tube; the liquid-storing cotton is concentric fitted on an inner wall of the cigarette pipe; the liquid-guiding cotton is concentric fitted on an inner wall of the liquid-storing cotton and is engaged with the atomizing device; the liquid-guiding cotton peripherally defines a groove; the first glass-fiber tube forms a spiral by a glass fiber being spirally wound, and is received in the groove; the second glass-fiber tube is fitted on an inner wall of the first glass-fiber tube and the liquid-guiding cotton, and is concentric to the cigarette pipe; the atomizing device is fixed in the cup body along its radial direction, and comprises a liquid-guiding piece which crosses corresponding holes of the second glass-fiber tube and then abutting on the inner wall of the first glass-fiber tube, and an electric heat wire round the liquid-guiding piece; whereby tobacco liquid is absorbed fast and much concentrated for the electric heat wire and the atomizing device is gripped and fixed tight.

* * * * *